United States Patent [19]

Wilson

[11] Patent Number: 4,517,873

[45] Date of Patent: May 21, 1985

[54] DIE CUTTING APPARATUS

[75] Inventor: John S. Wilson, Kirkwood, Mo.

[73] Assignee: Wilson Manufacturing Company, St. Louis, Mo.

[21] Appl. No.: 488,583

[22] Filed: Apr. 25, 1983

[51] Int. Cl.[3] ..... B26D 3/08; B26D 1/56; B26F 1/42

[52] U.S. Cl. ..... 83/881; 83/341; 83/346

[58] Field of Search ..... 83/346, 341, 881, 879

[56] References Cited

U.S. PATENT DOCUMENTS

| | | | |
|---|---|---|---|
| 3,203,292 | 8/1965 | Schmermund | 83/341 |
| 3,401,585 | 9/1968 | Schmermund | 83/341 |
| 3,977,283 | 8/1976 | Helm | 83/341 |
| 4,095,498 | 6/1978 | Biggar | 83/346 |
| 4,226,150 | 10/1980 | Reed | 83/346 |
| 4,381,688 | 5/1983 | Hardy | 83/346 |

*Primary Examiner*—Donald R. Schran

*Attorney, Agent, or Firm*—Senniger, Powers, Leavitt and Roedel

[57] ABSTRACT

Die cutting apparatus for making labels and the like wherein a web comprising a layer of pressure sensitive label material on a layer of backing material is fed forward between a pair of cooperating die and anvil rolls, the die roll being adapted to cut through the layer of pressure sensitive label material without cutting through the backing layer to form individual pressure sensitive labels on the backing layer. The die and anvil rolls are rotatable about axes lying in different vertical planes which are skewed with respect to one another for making the cutting action of the die roll a progressive slicing cut across the web.

20 Claims, 11 Drawing Figures

DIE CUTTING APPARATUS

BACKGROUND OF THE INVENTION

This invention relates generally to die cutting apparatus and more particularly to such apparatus which is useful in making pressure sensitive labels of the type which may be peeled off a backing or carrier sheet.

In conventional die cutting apparatus for making labels, a web comprising a layer of pressure sensitive material on a layer of backing material is fed between an engraved die roll and an anvil roll which cooperate to cut through the layer of pressure sensitive material without cutting through the backing layer to form individual pressure sensitive labels on the backing layer. In such apparatus the die and anvil rolls are typically mounted for rotation about horizontal axes lying in the same vertical plane, which is perpendicular to the direction of web feed. With the die and anvil rolls so disposed with respect to one another and with respect to the direction of web feed, "crosscuts" (cuts extending transversely of the web) made by the blades on the engraved die roll are made across the entire width of the web in one instantaneous chopping motion. This type of cutting action is disadvantageous in that it necessitates the use of high cutting pressures, which tends to cause the die roll to arch away from the anvil roll and the web. As a result, the pressure sensitive label material may not be completely cut through, which prevents proper stripping of the waste label material from the backing following the die cutting operation. To avoid this problem, engraved die rolls used in the past have had to be sufficiently large in diameter to resist substantial arching. However, such die rolls are expensive due to the extensive amount of engraving required to make the roll.

SUMMARY OF THE INVENTION

Among the several objects of this invention may be noted the provision of improved die cutting apparatus for use in label making machines; the provision of such apparatus wherein crosscuts are made by a progressive slicing cut rather than an instantaneous chopping cut thereby reducing the required cutting forces; the provision of such apparatus which enables a relatively small diameter die roll to be used, thereby reducing expense; the provision of such apparatus which is adapted to cut completely through the pressure sensitive label material across the entire width of the web without cutting through the backing material; and the provision of such apparatus which is easy to use and safe to operate.

Generally, die cutting apparatus of the present invention is for use in a machine for making pressure sensitive labels and the like of the type described above. The apparatus comprises a frame having a pair of side frame members at opposite sides of the frame, means for mounting an engraved die roll on the frame with the roll extending between the side frame members for rotation about a generally horizontal axis lying in a first vertical plane extending generally perpendicular to the direction of web feed, the die roll being of the type having a cylindric outer surface with die cutting means thereon extending generally axially with respect to the roll, an anvil roll having a cylindric outer surface, and means mounting the anvil roll on the frame with the roll extending between the side frame members for rotation about a generally horizontal axis lying in a second vertical plane skewed at an angle with respect to the said first vertical plane and with respect to the direction of web feed. The die and anvil rolls are rotatable about their respective horizontal axes with their cylindric surfaces so spaced with respect to one another that when the web is fed forwardly between the rolls said axial die cutting means on the die roll is adapted for cutting completely through the layer of pressure sensitive label material but not the backing layer to form label edges extending generally transversely with respect to the web, the aforesaid angle of skew being effective for making the cutting action of the axial die cutting means a progressive slicing cutting action which progresses across the web along a line which, relative to the anvil roll, extends generally axially of the anvil roll from a point on the roll on one side of a line of intersection between the anvil roll and said second vertical plane, over said line of intersection, and thence to a point on the anvil roll on the opposite side of said line of intersection.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
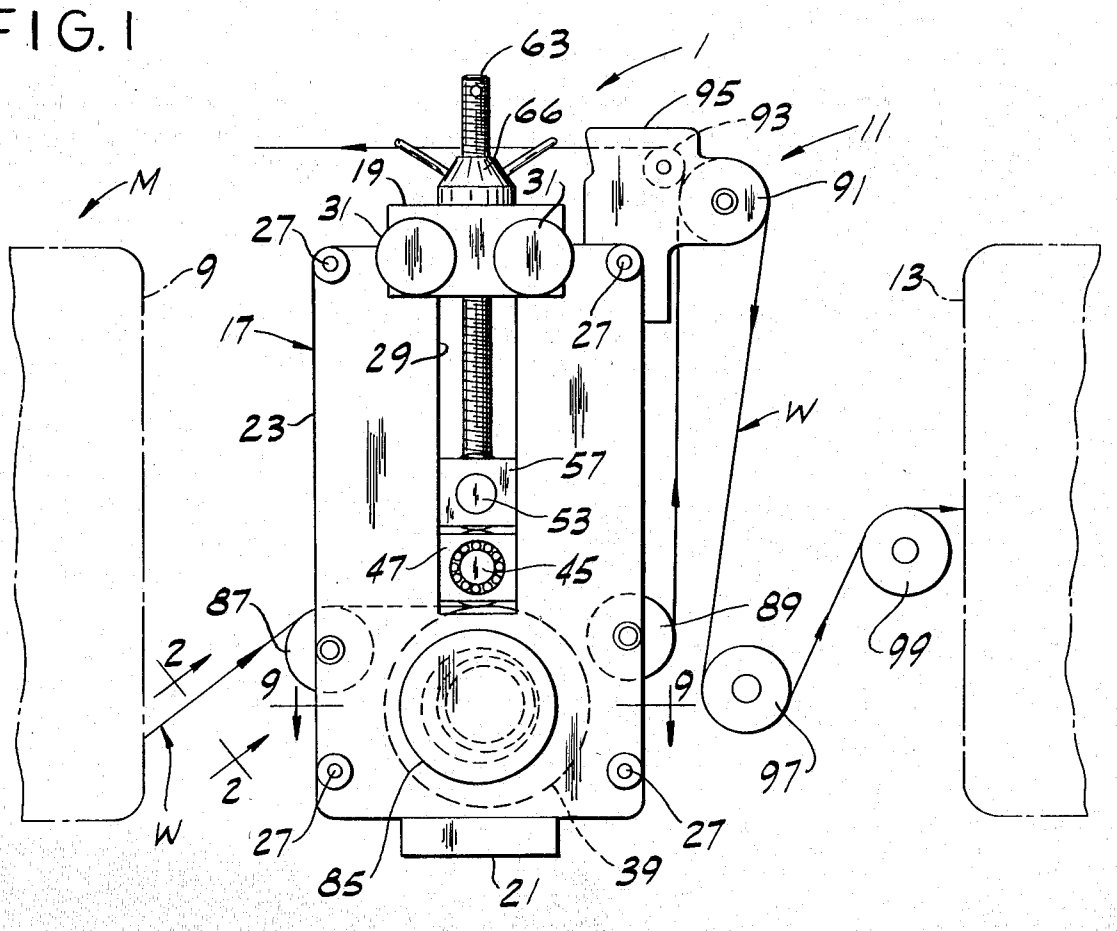
FIG. 1 is a side elevation of cutting apparatus of the present invention.
Figure 2:
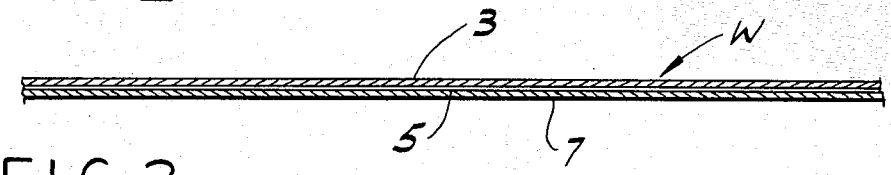
FIG. 2 is an enlarged section on line 2—2 of FIG. 1 showing a layered web construction.
Figure 3:
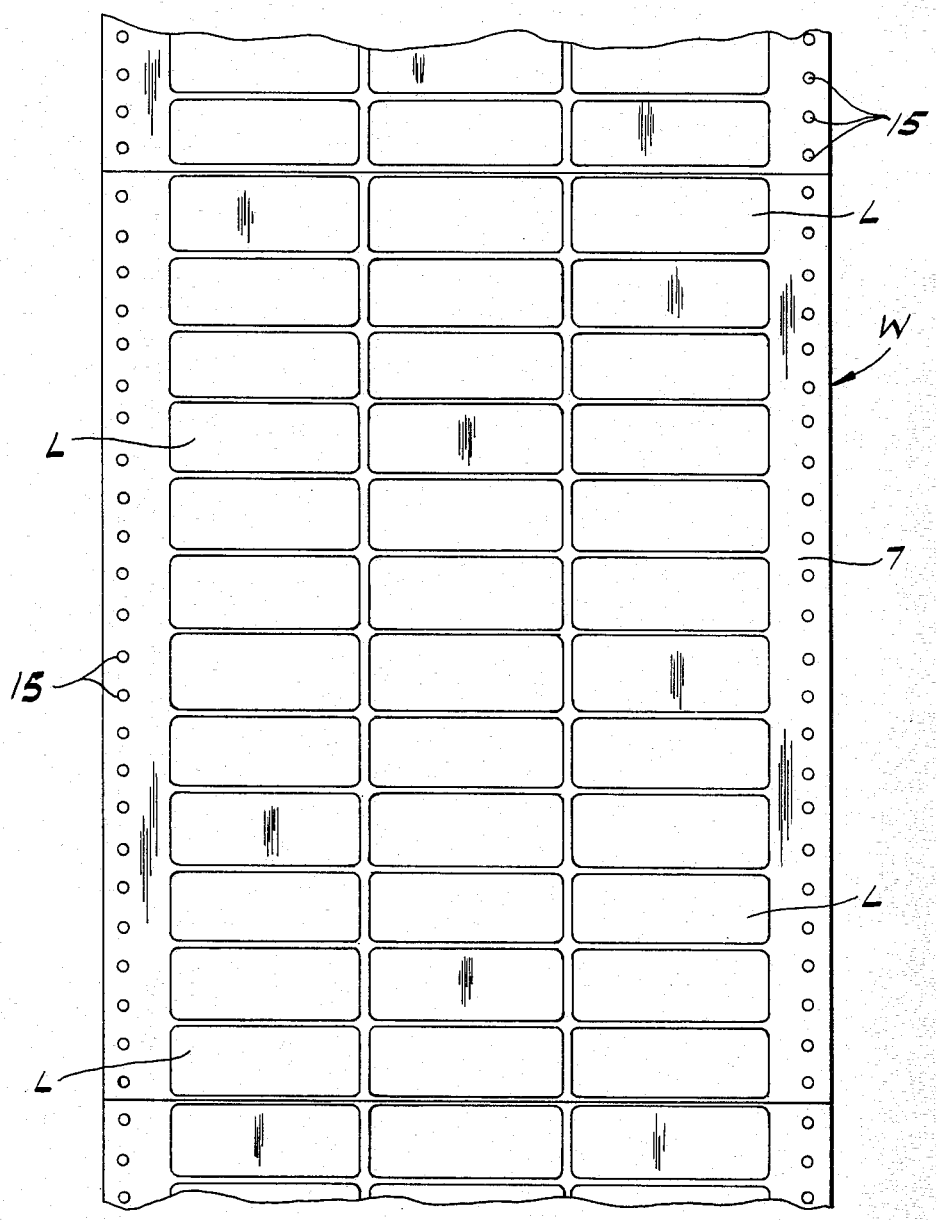
FIG. 3 is a view of a plurality of labels on a backing sheet.

Referring now to the drawings, there is generally indicated at 1 die cutting apparatus of the present invention especially adapted for use in a machine M for making labels and the like, particularly pressure sensitive labels. As illustrated in FIG. 1, the machine M may, for example, be of the type wherein a web W comprising a layer 3 of pressure sensitive material having a suitable adhesive 5 thereon, and a layer 7 of backing material (e.g., kraft paper) having a release coating thereon, is fed in a forward direction (from left to right as viewed in FIG. 1) from a printing station 9 where the pressure sensitive material is printed, through die cutting apparatus 1 which cuts through the layer 3 of pressure sensitive material without cutting through the backing layer 7 to form individual pressure sensitive labels L on the backing layer, through stripping apparatus, generally designated 11, which strips the waste label material from the backing layer 7, and thence to additional die cutting apparatus 13 which cuts a continuous series of holes 15 through the backing layer 7 along each side margin of the web. An end product of the machine M is shown in FIG. 3 (the printing on the labels being omitted). It will be understood that the die cutting apparatus of this invention may be used in other types of label-making machines as well.

Specifically, die cutting apparatus 1 comprises a frame, generally designated 17, comprising a top frame member 19, a bottom frame member 21 and a pair of opposing side frame members 23, 25 constituted by two generally rectangular metal plates connected by four tie rods, each designated 27. Each of the side frame members 23, 25 has a vertical slot 29 therein extending down from the upper edge of the side frame member. The top frame member 19 spans the upper ends of the two side frame members and closes the upper ends of the slots. It is removably secured to the side frame members by a pair of thumb screw fasteners 31 threaded through a depending flange 33 at one end of the top frame member into side frame members 25, and by a pair of shoulder bolts 35 at the other end of the top frame member threaded down into side frame member 23 (see FIG. 4).

Figure 5:
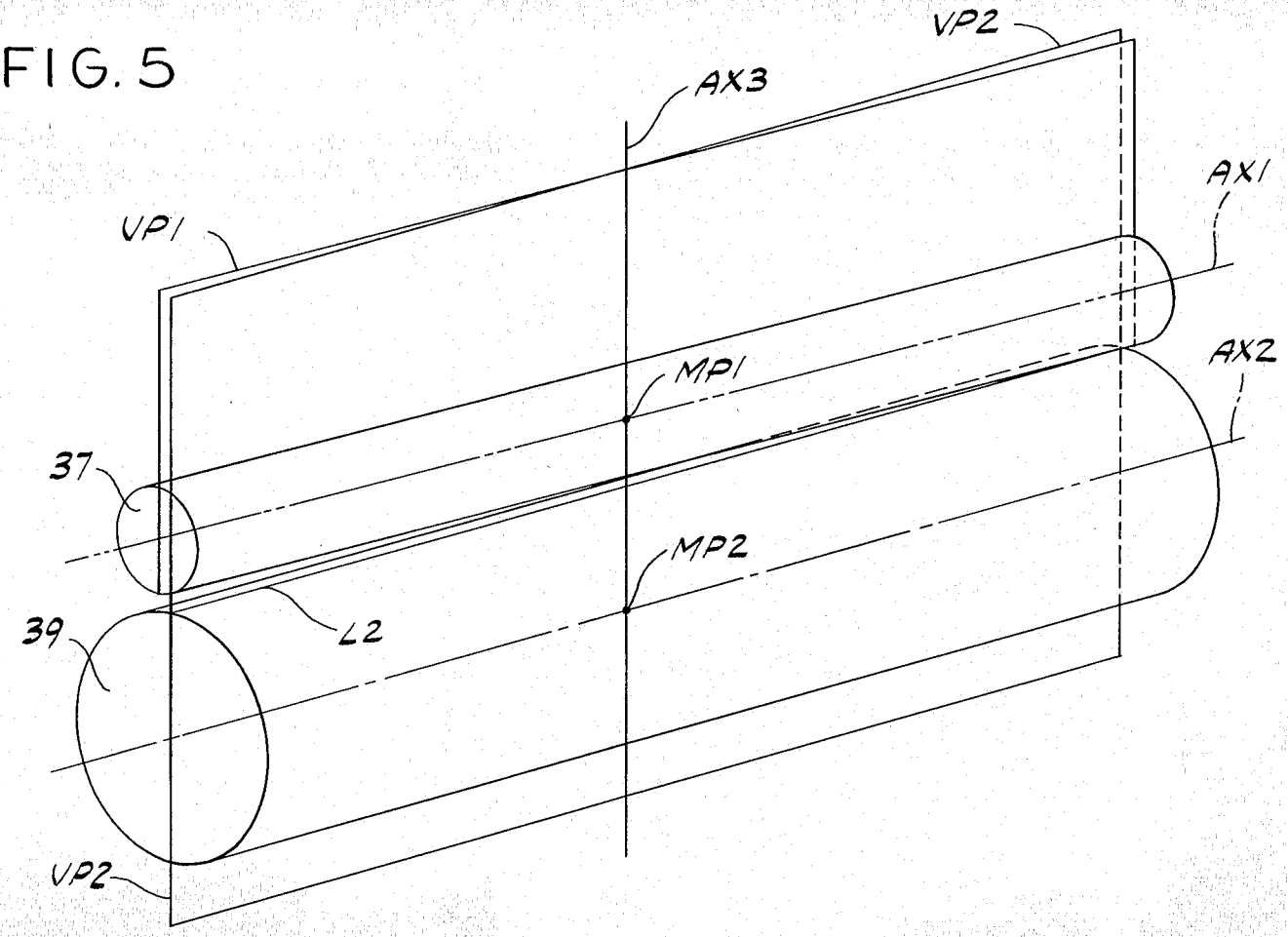
FIG. 5 is a schematic view of die and anvil rolls of the cutting apparatus illustrating their skewed orientation.

Die cutting apparatus 1 also includes a cooperating die and anvil rolls indicated at 37 and 39, respectively, for cutting the labels L in web W as the web is fed forwardly between the rolls. The die roll is mounted on the frame for rotation about a generally horizontal axis AX1 lying in a first vertical plane VP1 extending generally perpendicular to the direction of web feed. The anvil roll 39 is mounted on the frame immediately below the die roll 37 for rotation about a second horizontal axis AX2 lying in a second vertical plane VP2 skewed at an angle with respect to the vertical plane VP1 of the die roll and with respect to the direction of web feed. The longitudinal midpoints MP1, MP2 of the die and anvil rolls 37, 39 lie on the same vertical axis AX3, which corresponds to the line of intersection between planes VP1 and VP2 (see FIG. 5). As will be explained in more detail hereinafter, the angle of skew between vertical planes VP1 and VP2 ensures that all "crosscuts" (i.e., cuts extending transversely of the web) made by the die roll are progressive slicing cuts rather than instantaneous chopping cuts, which is advantageous for reasons set forth hereinafter.

Figure 6:
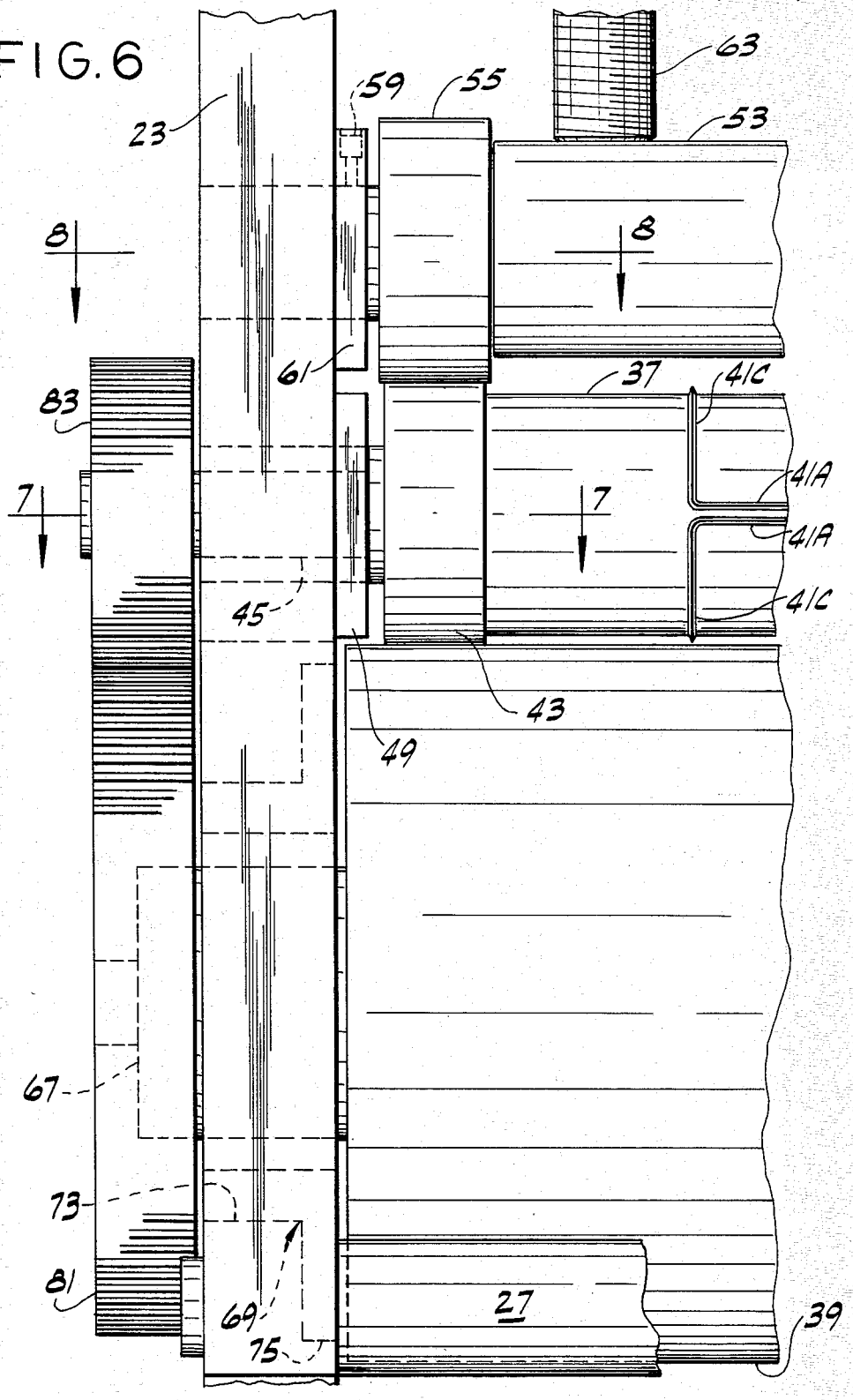
FIG. 6 is an enlarged portion of FIG. 4 illustrating details of the cutting apparatus.

The die roll 37 is of the engraved type and, in accordance with this invention, is of relatively small diameter (e.g., 2 inches or 5.1 cm). It has a cylindric outer surface which is engraved to have a pattern of die blades 41 thereon for cutting labels L in web W. Thus the pattern comprises a series of blades 41A extending generally axially on the cylindric surface of the roll for cutting label edges in the transverse direction with respect to the web, and a series of blades 41C extending generally circumferentially of the roll for cutting label edges in the longitudinal direction with respect to the web (FIG. 6). The blades are generally V-shaped in cross sections, tapering outwardly from the roll to a relatively sharp cutting edge for readily penetrating the pressure sensitive layer 3 of web W. The die roll has enlarged diameter portions toward its ends forming a pair of cylindric bearers 43 (constituting bearer means) which are adapted for rolling contact with the anvil roll 39 to space the cylindric outer surface of the die roll a predetermined distance from the cylindric outer surface of the anvil roll, the distance being such that the die blades 41 on the anvil roll are adapted to cut completely through the layer 3 of pressure sensitive material but not through the backing layer 7. Thus the blades on the die roll never contact the anvil roll. The spacing between the bearers 43 on the die roll is greater than the width of the widest web W to be handled by the die cutting apparatus 1.

Figure 7:
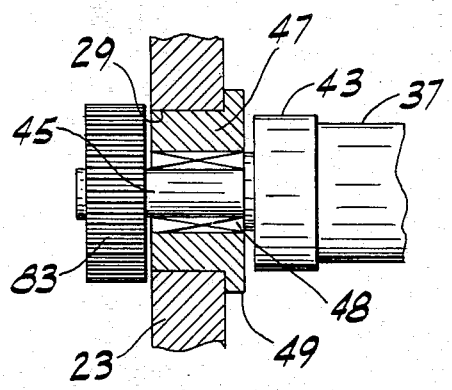
FIG. 7 is a horizontal section on line 7—7 of FIG. 6.

The ends of the die roll 37 are of reduced diameter, as indicated at 45, and are journaled in bearing members or blocks 47 equipped with suitable bearings 48 (e.g., roller bearings). These blocks 47 are slidable in the vertical slots 29 (which thus constitute guideways) in the side frame members 23, 25 to provide vertical adjustment for die rolls of different diameter. The bearing blocks have side flanges 49 thereon which are engageable with the inner (opposing) faces of the two side frame members to maintain the blocks in proper position within the guideways (see FIG. 7).

Figure 4:
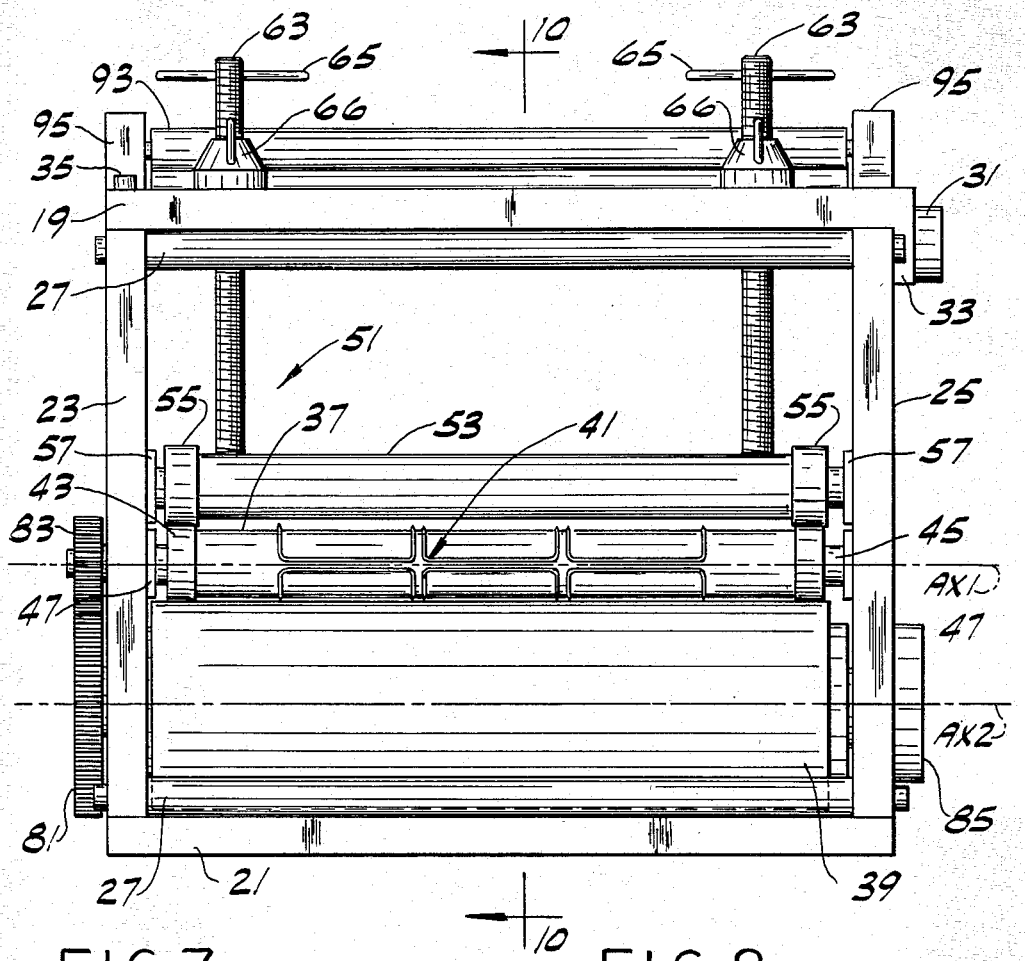
FIG. 4 is a front elevation of the cutting apparatus.
Figure 8:
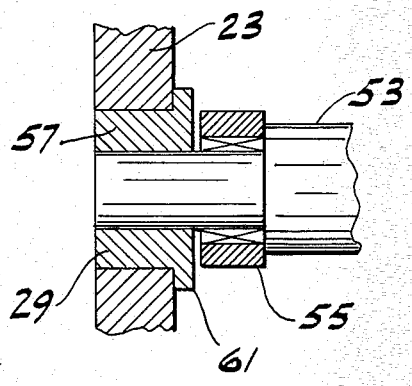
FIG. 8 is a horizontal section on line 8—8 of FIG. 6.

Indicated generally at 51 in FIG. 4 is means for holding the die roll 37 against vertical movement away from the anvil roll 39 as the web W is fed between the rolls and die cut. Means 51 comprises a hold-down bar 53 of solid bar stock mounted in horizontal position between the side frame members 23, 25 above the die roll. This bar 53 has a pair of rollers 55 thereon which are rotatable relative to the bar on the longitudinal axis of the bar, and which are disposed for rolling engagement with the bearers 43 on the die roll. The ends of the hold-down bar are mounted in slide blocks 57 which are also slidable in the slots 29 in the side frame members. Slide blocks 57 are secured in fixed position with respect to the hold-down bar by setscrews 59 or other suitable means. As in the case of the bearing blocks 47 associated with the die roll 37, slide blocks 57 also have flanges 61 engageable with the inner (opposing) faces of the two side frame members 23, 25 (FIG. 8).

Means 51 also includes a pair of load screws, each designated 63, which are engageable with the hold-down bar 53 for exerting a downward vertical force against the bar thereby to press the rollers 55 on the bar against the bearers 43 on the die roll and the bearers against the anvil roll. The externally threaded load screws 63 are threadably engageable with the top frame member 19 and are threadable down through the member. Handles 65 are provided at the upper ends of the load screws for rotating them about vertical axes to bring the lower ends of the screws into pressure engagement with the hold-down bar at points on the bar between rollers 55. The load screws are locked in this position by lock nuts 66 threaded on the upper ends of the load screws into engagement with the upper surface of the top frame member.

Figure 9:
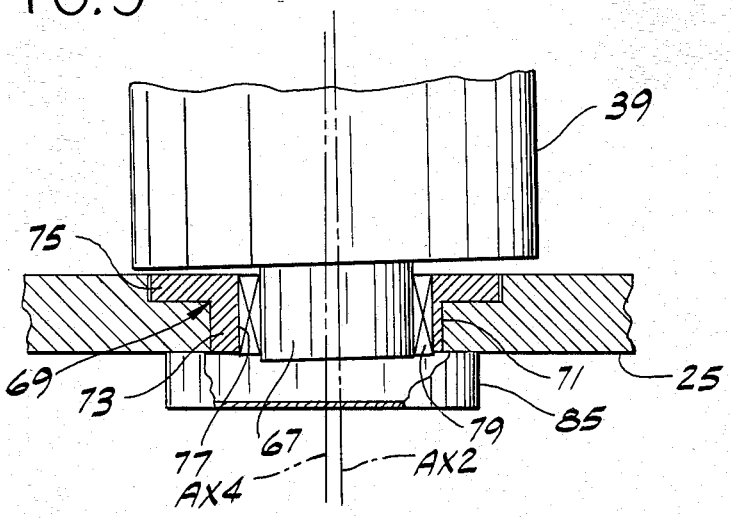
FIG. 9 is an enlarged horizontal section on line 9—9 of FIG. 1.

The anvil roll 39 is considerably larger in diameter than the die roll 37 (e.g., 5.4 inches or 13.7 cm. compared to 2 inches or 5.1 cm.) and has a cylindric outer surface which is adapted to support the web W as it is fed between the rolls and die cut. The ends of the anvil roll are of reduced diameter, as indicated at 67, and are journalled in a pair of identical housings, each generally designated 69, secured in fixed position with respect to the frame in openings 71 through the side frame members 23, 25. As best illustrated in FIG. 9, each housing comprises a generally cylindric hub 73 and a circular flange 75 extending radially outwardly from the hub for flange mounting the hub in opening 71 in a position in which the central axis AX4 of the hub lies generally in the central vertical plane VP1 of the die roll 37. The hub has an opening therethrough constituted by a circular bore 77 receiving a respective end of the anvil roll, the central axis of the bore being generally coincident with the axis AX2 of the anvil roll. Thus the axis of the bore 77 is skewed with respect to the axis AX3 of the hub 73 at an angle corresponding to the skew angle between the stated first and second central vertical planes VP1, VP2 of the die and anvil rolls. Suitable bearings 79 (constituting bearing means) are provided for rotatably supporting a respective end of the anvil in the housing.

The anvil roll 39 has a relatively large spur gear 81 on one end thereof (its left end as viewed in FIG. 4) in mesh with a smaller pinion gear 83 on the die roll 37. These gears are adapted to be driven by suitable drive gearing (not shown) of machine M. The spur gear 81 is sufficiently large to cover the outer open end of the adjacent hub 73 to minimuze entry of foreign matter into the housing. A cap 85 fastened to side frame member 25 serves the same function for the outer housing.

Figure 10:
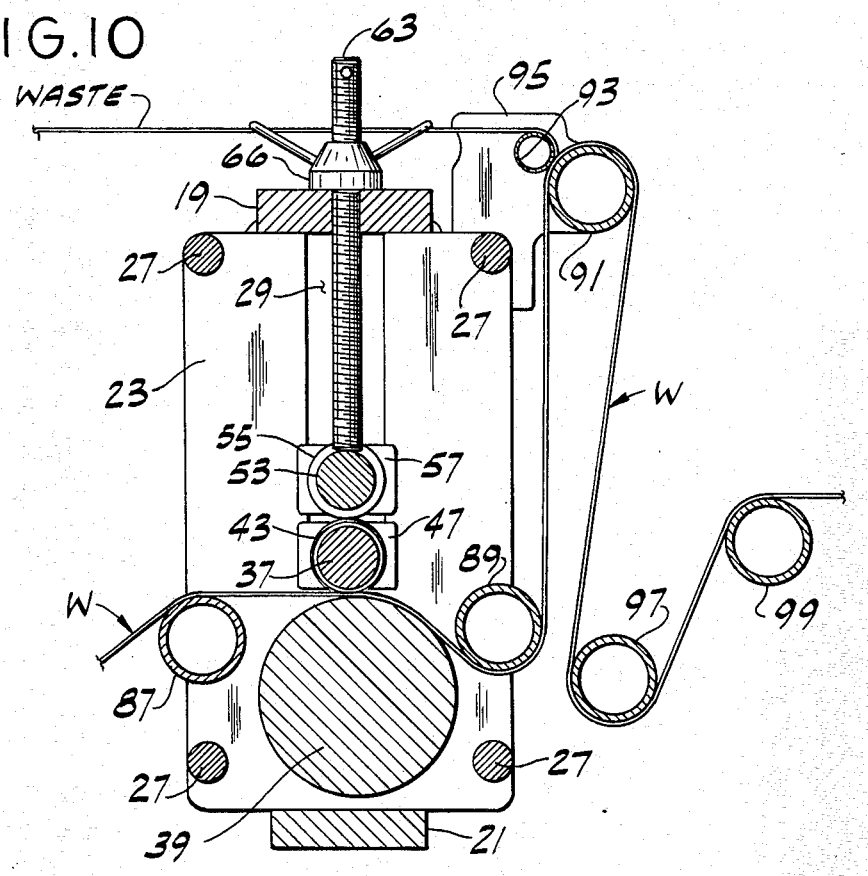
FIG. 10 is a vertical section on line 10—10 of FIG. 4.

Idler rolls 87 and 89 rotatably mounted on the frame 17 immediately upstream and downstream from the die and anvil roll 37, 39 are provided for guiding the web W forwardly between the rolls and then directing the die cut web up toward the stripping apparatus 11 (see FIG. 10). The latter comprises a cluster of horizontal idler rolls (two such rolls designated 91 and 93 being shown) rotatably carried by a pair of mounting plates 95 fastened to the upper ends of the side frame members 23, 25 at the rearward (downstream) end of the die cutting apparatus. As the web W passes between rollers 91 and 93, the waste (non-label) portions of layer 3 are stripped (i.e., peeled) from the backing layer 7 and directed to a power-driven take-up roll (not shown). Two additional horizontal idler rolls 97, 99 are provided for directing the stripped web W into apparatus 13 for die cutting holes 15 in the side margins of the web. It will be understood that a power-driven roller (not shown) is provided upstream of apparatus 13 for pulling the web W through the machine M.

Figure 11:
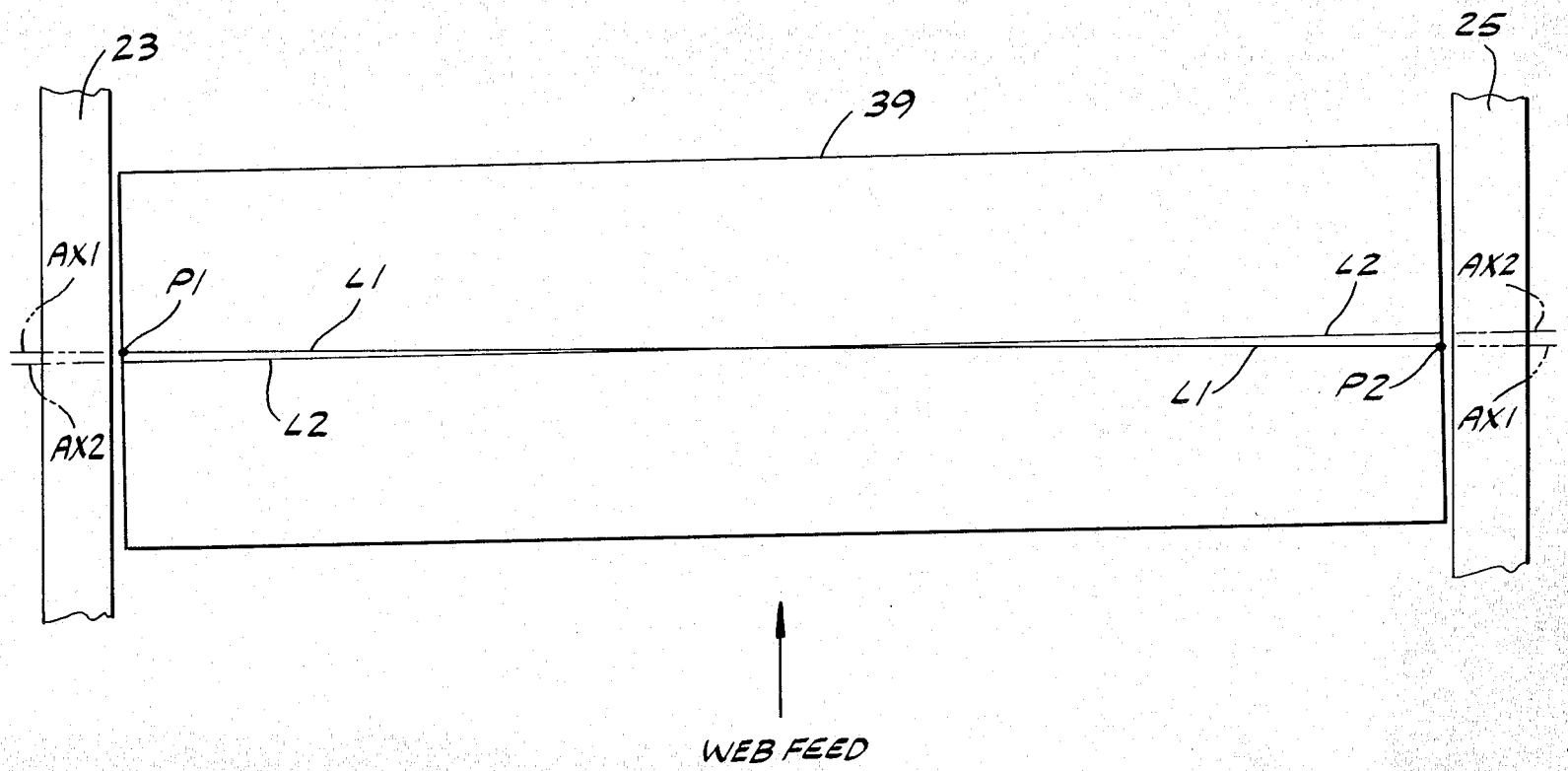
FIG. 11 is a schematic plan view of the anvil roll illustrating the cutting action of the die roll (relative to the anvil roll) as it makes a crosscut.

In the operation of machine M, web W is fed forwardly through the machine from printing station 9 (where printing is applied to the pressure sensitive layer 3 of material) up over idler roll 87 and thence between the rotating die and anvil rolls 37, 39 which are so spaced with respect to one another that the die blades 41 on the die roll cut completely through the layer 3 of pressure sensitive label material but not the backing layer 7, with the axial die blades 41A making the label cuts extending transversely with respect to the web (i.e., the "crosscuts"), and the circumferential die blades 41C making the label cuts extending longitudinally with respect to the web. In accordance with this invention, the cutting action of the axial die blades 41A is a progressive slicing cutting action rather than an instantaneous chopping cutting action across the entire width of the web. This is because of the stated angle of skew between the central vertical planes VP1, VP2 of the die and anvil rolls. Thus, as best illustrated in FIG. 11, the cut made by an axial die blade 41A progresses across the web W along an imaginary line L1 which, relative to the anvil roll, extends generally axially of the anvil roll from a point (such as point P1) on the roll on one side of a line L2 of intersection between the anvil roll and the central vertical plane VP2 of the anvil roll, up over the intersection line L2, and thence down to a point (such as point P2) on the anvil roll on the opposite side of line L2. Of course, because each die blade 41A shown in the drawings is relatively short compared to the length of the anvil roll, the cut which it effects on each revolution of the die roll will trace only a portion of line L1. If the die blade 41A were as long as the anvil roll, it would make a progressive slicing cut which, relative to the anvil roll, would trace the entire line L1 shown in the drawings.

The fact that the cutting action of the axial die blades 41A is a progressive slicing cutting action has several important advantages, one being that the cutting pressures involved in making "crosscuts" are reduced considerably. This in turn reduces the tendency of the die roll 37 to bow or arch away from the anvil roll 39. As a result, the size (diameter) of the engraved die roll may be decreased with consequent cost savings. Moreover, the skewed orientation of the die and anvil rolls compensates for any small amount of arching that may occur. It will be observed in this regard that the bearers 43 on the die roll contact the cylindric outer surface of the anvil roll on opposite sides of line L2. Thus, because the outer surface of the anvil roll is cylindric, the spacing between the outer surfaces of the die and anvil rolls (when the rolls are unstressed) is slightly less at the middle of the rolls than at the ends of the roll. The slight arching of the die roll as it cuts web W will offset this difference so that the distance between the two rolls is approximately equal across the entire width of the web W. Accordingly, the axial die blades 41A effect an even cut completely through the layer 3 of pressure sensitive material (but not the backing layer 7) across the entire width of the web.

The objectives of the present invention may be achieved with only a relatively small angle of skew between the central vertical planes VP1, VP2 of the die and anvil rolls. For example, it has been found that for an anvil roll about 5.4 inches (13.7 cm.) in diameter and a die roll about 2 inches (5.1 cm.) in diameter, a skew angle of about one degree is entirely satisfactory in accomplishing the desired results. The exact angle required in a given application will depend on the size of the die roll and the size of the anvil roll. Thus, the smaller the diameter of the die roll, the greater will be its tendency to arch. Accordingly, for a given size anvil roll, a smaller die roll will require a greater skew angle to compensate for the greater arch. Similarly, the smaller the diameter of the anvil roll, the smaller will be the radius of curvature of its outer surface. Accordingly, for a given size die roll, a smaller anvil roll will require a smaller skew angle to compensate for the arch.

After exiting from between the die and anvil rolls 37, 39 the web W is directed under idler roll 89 and up between rolls 91 and 93 of stripping apparatus 11 where the waste label material is stripped from the web and guided to a take-up roll (not shown) on which it is wound for disposal. The stripped web W then feeds down and around idler roll 97 which guides it up and over idler roll 99 to apparatus 13 for die cutting holes 15 in the web.

In the event die roll 37 is to be replaced, the top frame member 19 is simply removed (by loosening thumb screw fasteners 31 and shoulder bolts 35), the hold-down bar 53 and die roll 37 lifted out of slots 29, a new die roll lowered into position, and the hold-down bar replaced on top of the die roll with the rollers 55 on the hold-down bar in rolling contact with the bearers on the new die roll. After the top frame member 19 is secured atop the frame, the load screws 63 are rotated about their vertical axes to thread them down into pressure engagement with the hold-down bar, which serves to hold both the hold-down bar and the die roll against upward vertical movement away from the anvil roll.

The lock nuts 66 are then tightened down against the top frame member to lock the load screws in position.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. Die cutting apparatus for use in a machine for making labels and the like, said machine being of the type wherein a web comprising a layer of pressure sensitive label material on a layer of backing material is fed in a forward direction through the machine, said apparatus being adapted to cut through said layer of pressure sensitive label material as it is fed forwardly without cutting through said backing layer thereby to form individual pressure sensitive labels on the backing layer, said apparatus comprising:

a frame having a pair of side frame members at opposite sides of the frame;

an engraved die roll having a cylindric outer surface with die cutting means thereon extending generally axially with respect to the roll;

means for mounting the die roll on the frame with the roll extending between the side frame members for rotation about a generally horizontal axis lying in a first vertical plane extending generally perpendicular to the direction of web feed;

an anvil roll having a cylindric outer surface; and means mounting the anvil roll on the frame with the roll extending between the side frame members for rotation about a generally horizontal axis lying in a second vertical plane skewed at an angle with respect to the said first vertical plane and with respect to the direction of web feed;

said die and anvil rolls being rotatable about their respective horizontal axes with their cylindric surfaces so spaced with respect to one another that when said web is fed forwardly between the rolls said axial die cutting means on the die roll is adapted for cutting completely through said layer of pressure sensitive label material but not said backing layer to form label edges extending generally transversely with respect to the web, said angle of skew being effective for making the cutting action of said axial die cutting means a progressive slicing cutting action which progresses across the web along a line which, relative to the anvil roll, extends generally axially of the anvil roll from a point on the roll on one side of a line of intersection between the anvil roll and said second vertical plane, over said line of intersection, and thence to a point on the anvil roll on the opposite side of said line of intersection.

2. Die cutting apparatus as set forth in claim 1 wherein said first and second vertical planes intersect in a line passing generally through the longitudinal midpoint of the anvil roll.

3. Die cutting apparatus as set forth in claim 1 wherein said die roll mounting means comprises a pair of bearing members slidable in vertical guideways in said side frame members, the ends of said die roll being journalled in said bearing members.

4. Die cutting apparatus as set forth in claim 3 further comprising means for holding the die roll against vertical movement away from the anvil roll as said web is fed between the rolls and die cut.

5. Die cutting apparatus as set forth in claim 4 wherein said a die roll has bearer means at its ends adapted to bear against the anvil roll for spacing the outer cylindric surface of the die roll a predetermined distance from the outer cylindric surface of the anvil roll, said holding means comprising a hold-down bar having rollers adjacent its ends, said hold-down bar being adapted to be mounted in horizontal position between said side frame members with said rollers in rolling engagement with said bearer means on the die roll, and means engageable with said hold-down bar for exerting a vertical force against the bar thereby to press the rollers against said bearer means and said bearer means against said anvil roll.

6. Die cutting apparatus as set forth in claim 5 wherein the ends of said hold-down bar are mounted in slide members slidable vertically in said guideways.

7. Die cutting apparatus as set forth in claim 5 wherein said means for exerting a vertical force comprises a pair of screws mounted on the frame for rotation about generally vertical axes, said screws being rotatable about their respective axes to bring them into pressure engagement with said hold-down bar.

8. Die cutting apparatus as set forth in claim 1 wherein said anvil roll mounting means comprises a pair of housings secured in fixed position to said side frame members, and bearing means in an opening in each housing for rotatably supporting a respective end of the anvil roll in the housing, the axis of said opening being generally coincident with the axis of rotation of the anvil roll.

9. Die cutting apparatus as set forth in claim 8 wherein each housing comprises a generally cylindric hub having said opening therethrough, said opening being constituted by a circular bore having a central axis skewed with respect to the central axis of the hub at an angle corresponding to the skew angle between said first and second vertical planes, and means for mounting the hub with the axis of said opening generally coincident with that of the axis of rotation of said anvil roll.

10. Die cutting apparatus as set forth in claim 9 wherein said hub mounting means comprises a flange extending radially with respect to the hub for flange mounting the hub in said opening of a respective side frame member.

11. Die cutting apparatus as set forth in claim 1 wherein said axial die cutting means is constituted by a plurality of cutting blades extending generally axially of the die roll.

12. Die cutting apparatus as set forth in claim 11 wherein said first and second vertical planes intersect in a line passing generally through the longitudinal midpoints of the die and anvil rolls.

13. Die cutting apparatus as set forth in claim 11 wherein said anvil roll is mounted adjacent the bottom of said frame and said die roll is adapted to be mounted above the anvil roll.

14. Die cutting apparatus as set forth in claim 13 wherein said die roll mounting means comprises a pair of bearing members slidable in vertical guideways in said side frame members, the ends of said die roll being journalled in said bearing members.

15. Die cutting apparatus as set forth in claim 14 further comprising means for holding the die roll against upward vertical movement away from the anvil roll as said web is fed between the rolls and die cut.

16. Die cutting apparatus as set forth in claim 15 wherein said die roll has bearer means at its ends adapted to bear against the anvil roll for spacing the outer cylindric surface of the die roll a predetermined distance from the outer cylindric surface of the anvil roll, said holding means comprising a hold-down bar having rollers adjacent its ends, said bar being adapted to be mounted in horizontal position between said side frame members above the die roll with said rollers in rolling engagement with said bearer means on the die roll, and means engageable with said hold-down bar for exerting a downward vertical force against the bar thereby to press the rollers against said bearer means and said bearer means against said anvil roll.

17. Die cutting apparatus as set forth in claim 16 wherein the ends of said hold-down bar are mounted in slide members slidable vertically in said guideways.

18. Die cutting apparatus as set forth in claim 13 wherein said anvil roll mounting means comprises a pair of housings secured in fixed position to said side frame members, and bearing means in an opening in each housing for rotatably supporting a respective end of the anvil roll in the housing, the axis of said opening being generally coincident with the axis of rotation of the anvil roll.

19. Die cutting apparatus as set forth in claim 18 wherein each housing comprises a cylindric hub having said opening therethrough, said opening being constituted by a circular bore having a central axis skewed with respect to the central axis of the hub at an angle corresponding to the skew angle between said first and second vertical planes, and means for mounting the hub with the axis of said opening generally coincident with that of the axis of rotation of said anvil roll.

20. Die cutting apparatus as set forth in claim 19 wherein said hub mounting means comprises a flange extending radially with respect to the hub for flange mounting the hub on a respective side frame member.

* * * * *